US008171759B2

(12) United States Patent
Yoo et al.

(10) Patent No.: US 8,171,759 B2
(45) Date of Patent: May 8, 2012

(54) LAUNDRY TREATING APPARATUS

(75) Inventors: Sang Hee Yoo, Gyeongsangnam-do (KR); Jong Deuk Bae, Gyeongsangnam-do (KR); Kil Su Kim, Gyeongsangnam-do (KR); Ji Maeng Kim, Gyeongsangnam-so (KR); Young Bae Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 548 days.

(21) Appl. No.: 12/402,951

(22) Filed: Mar. 12, 2009

(65) Prior Publication Data

US 2009/0229316 A1 Sep. 17, 2009

(30) Foreign Application Priority Data

Mar. 13, 2008 (KR) ..... 10-2008-0023572

(51) Int. Cl.
*D06F 37/10* (2006.01)
*D06F 37/18* (2006.01)

(52) U.S. Cl. ..... 68/196; 68/3 R

(58) Field of Classification Search ..... 68/3 R, 68/196

See application file for complete search history.

(56) References Cited

U.S. PATENT DOCUMENTS 3,115,457 A * 12/1963 Simons ..... 210/232
2005/0107741 A1* 5/2005 Willard et al. ..... 604/113

FOREIGN PATENT DOCUMENTS

JP 2005329045 * 12/2005

* cited by examiner

*Primary Examiner* — Saeed T Chaudhry
(74) *Attorney, Agent, or Firm* — Birch, Stewart, Kolasch & Birch, LLP

(57) ABSTRACT

A laundry treating apparatus is disclosed. The laundry treating apparatus includes an outer case defining an appearance of the laundry treating apparatus, a washing tub arranged in the outer case, to receive laundry, a top lid mounted to a top of the outer case such that the top lid is openable and closeable, and an air flow assembly mounted to the top lid, to stepwise adjust a size of a passage communicating an interior of the outer case and an exterior of the outer case. The laundry treating apparatus can prevent moisture from staying in the interior of the laundry treating apparatus for a prolonged period of time, thereby preventing a failure of the laundry treating apparatus, generation of an offensive odor and propagation of bacteria in the interior of the laundry treating apparatus.

11 Claims, 7 Drawing Sheets

LAUNDRY TREATING APPARATUS

This application claims the benefit of Korean Patent Application No. 10-2008-0023572, filed on Mar. 13, 2008, which is hereby incorporated by reference as if fully set forth herein.

BACKGROUND OF THE INVENTION

1. Field of the Invention

The present invention relates to a laundry treating apparatus, and more particularly to a laundry treating apparatus capable of removing moisture form the interior of the laundry treating apparatus after the completion of operation of the laundry treating apparatus, thereby preventing generation of an offensive odor and propagation of bacteria caused by moisture in the interior of the laundry treating apparatus.

2. Discussion of the Related Art

A laundry treating apparatus means a machine used to perform a treatment such as washing, drying, and regeneration. Typically, such a laundry treating apparatus means a washing machine having a function to wash laundry, a drying machine having a function to dry washed laundry, or a washing/drying machine having both the washing and drying functions.

Generally, such a conventional laundry treating apparatus is of a top loading type in which laundry is loaded into the laundry treating apparatus through the top of an outer case. In this case, accordingly, a top lid provided at the top of the outer case is opened when it is desired to load laundry into the laundry treating apparatus. The laundry treating apparatus operates under the condition in which the top lid is closed. In order to unload the laundry after the completion of the operation, the top lid is again opened.

Generally, the above-mentioned conventional laundry treating apparatus is maintained in a sealed state after the unloading of the laundry. For this reason, there is a problem in that the laundry treating apparatus get damp due to water left in the interior thereof after the completion of the operation.

In this case, a circuit board included in a control panel of the laundry treating apparatus may be short-circuited due to moisture. In addition, where the laundry treating apparatus is maintained in the sealed state for a prolonged period of time, there may be a sanitation problem in that an offensive odor may be generated, or mold or bacteria may propagate.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus, in which the interior of the laundry treating apparatus can communicate with the exterior of the laundry treating apparatus, to flow air therebetween, thereby being capable of preventing the interior of the laundry treating apparatus from getting damp.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises: an outer case defining an appearance of the laundry treating apparatus; a washing tub arranged in the outer case, to receive laundry; a top lid mounted to a top of the outer case such that the top lid is openable and closeable; and an air flow assembly mounted to the top lid, to stepwise adjust a size of a passage communicating an interior of the outer case and an exterior of the outer case.

The air flow assembly may comprise a door stepwise pivotable to stepwise adjust an opening/closing degree of the passage. The door may comprise a plurality of pivot arms extending from one side of the door, to support the door, and a hinge unit pivotably supporting the pivot arms.

The hinge unit may comprise a boss protruded from one side of each pivot arm, an engagement rib protruded from one end of the pivot arm while being spaced apart from the boss, and a pivot support formed at a lower surface of the top lid, to pivotably support the boss.

The pivot support may comprise a boss groove to pivotably receive the boss, and a plurality of protrusions engaged, at a selected one thereof, with the engagement rib in a state in which the boss is received in the boss groove, to stepwise restrict a pivoting angle of the pivot arm.

A pivotal angle of the door may be adjusted as the engagement rib passes over the selected protrusion when the door is pressed, and is then engaged with a next one of the protrusions.

The protrusions may be formed along a circumferential direction of the boss. Each protrusion may have an inclined surface to allow the engagement rib to easily pass over the protrusion when the door is pressed.

At least one of the engagement rib and each protrusion may have a predetermined elasticity to allow the protrusion rib to pass over the protrusion.

The hinge unit may comprise a boss protruded from one side of each pivot arm, a plurality of engagement ribs protruded from the pivot arm around the boss while being spaced apart from the boss by a predetermined distance, and a pivot support formed at a lower surface of the top lid, to pivotably support the boss.

The engagement ribs may have a cylindrical shape, and may be continuously connected to one another around the boss.

The pivot support may comprise a boss groove to pivotably receive the boss, a step formed to be stepped from the boss groove while being concentric with the boss groove and radially spaced apart from the boss groove by a predetermined distance, and a plurality of protrusions protruded from an inner circumferential surface of the step. Each protrusion may be engaged between adjacent ones of the engagement ribs, to stepwise restrict a pivoting angle of the pivot arm.

The step and the protrusions may form a shape corresponding to a shape formed by the engagement ribs.

A pivotal angle of the door may be adjusted as each engagement rib passes over the protrusions engaged with the engagement rib when the door is pressed, and is then engaged between next ones of the protrusions.

At least one of each engagement rib and each protrusion may have a predetermined elasticity to allow the protrusion rib to pass over the protrusion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

The present invention is applied, in an exemplary embodiment thereof, to a washing machine for washing laundry loaded therein. Of course, the present invention is not limited to this application. The present invention is applicable to any laundry treating apparatus as long as the laundry treating apparatus is configured to treat laundry therein, using water supplied from the outside thereof.

Figure 1:
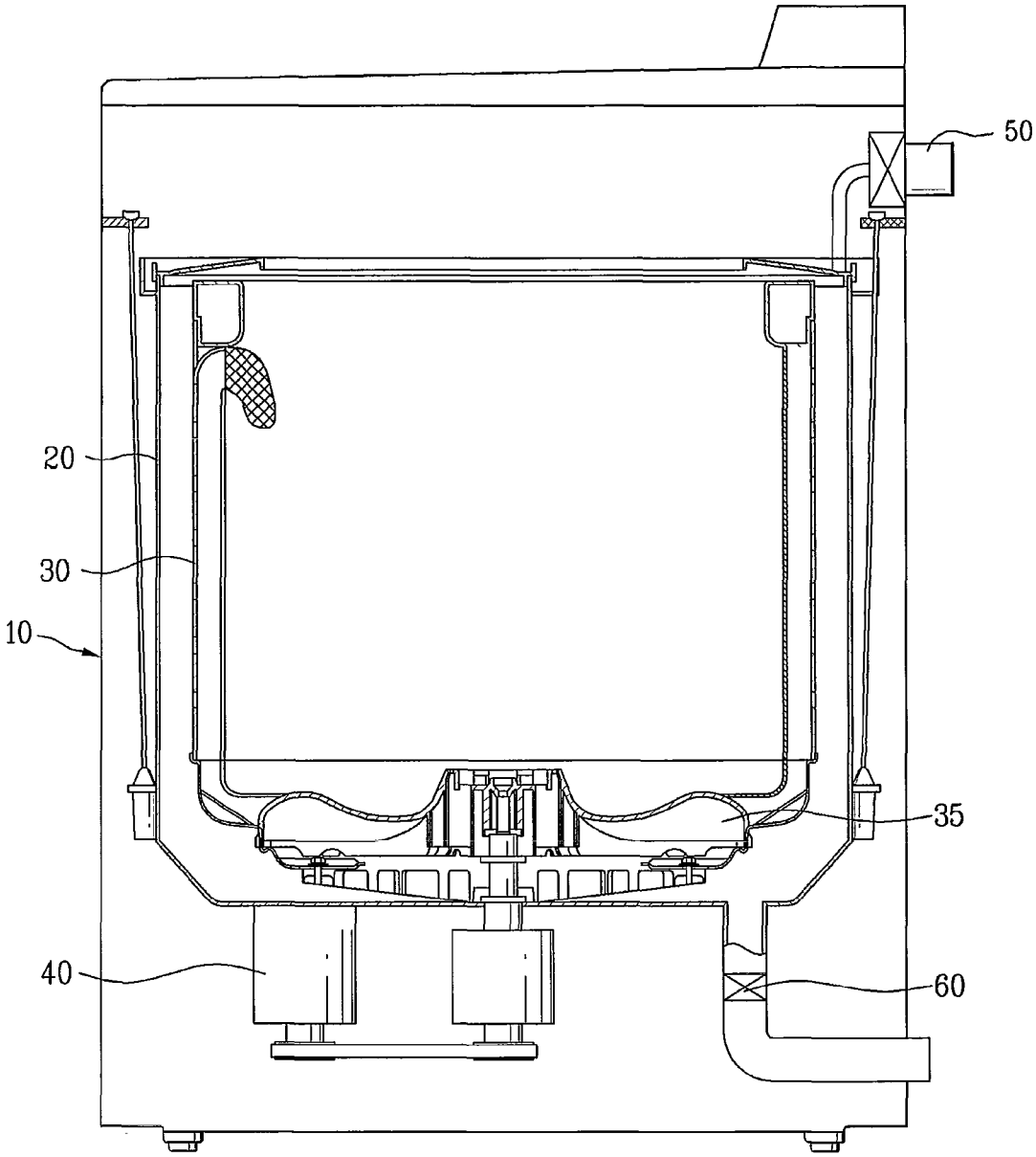
FIG. 1 is a sectional view illustrating an inner configuration of a laundry treating apparatus according to an exemplary embodiment of the present invention.
Figure 2:
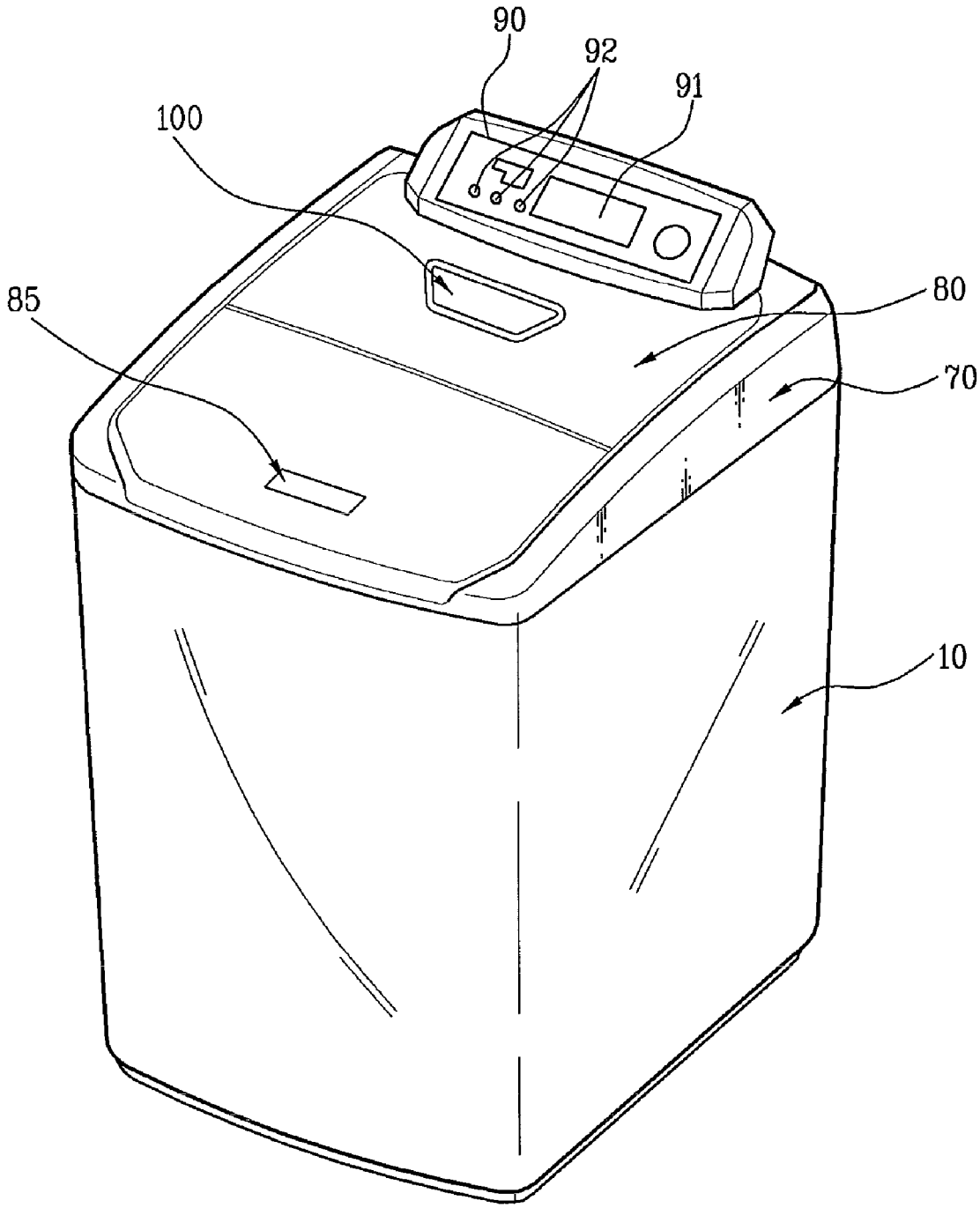
FIG. 2 is a perspective view illustrating an appearance of the laundry treating apparatus according to the illustrated embodiment of the present invention.

FIG. 1 is a sectional view illustrating an inner configuration of a laundry treating apparatus according to an exemplary embodiment of the present invention. FIG. 2 is a perspective view illustrating an appearance of the laundry treating apparatus according to the illustrated embodiment of the present invention.

As shown in FIG. 1, the laundry treating apparatus according to the illustrated embodiment of the present invention includes an outer case 10, a water tub 20 arranged in the outer case 10, to receive wash water, and a washing tub 30 arranged in the water tub 20, to perform washing and spin-drying operations for laundry. The laundry treating apparatus also includes a pulsator 35 mounted to a bottom of the washing tub 30 within the washing tub 30, to generate a flow of water in accordance with rotation thereof, and thus to wash the laundry, and a driving unit 40 connected to the pulsator 35, to rotate the pulsator 35.

A water supply unit 50 is installed at a top of the water tub 20, to supply wash water to the water tub 20. At a bottom of the water tub 20, a draining unit 60 is installed to externally drain wash water.

The laundry treating apparatus according to the illustrated embodiment of the present invention further includes a top lid 80 mounted to a top of the outer case 10 such that it can be opened and closed.

In addition to the washing tub 30, various devices for performing operations for treatment of laundry are installed in the outer case 10. The outer case 10 defines the appearance of the laundry treating apparatus while protecting the devices installed therein.

A top cover 70 is mounted to the top of the outer case 10. A control panel 90 for controlling the laundry treating apparatus is mounted to an upper surface of the top cover 70, in addition to the top lid 80.

The control panel 90 may include various operating elements 92 for allowing the user to control operation of the laundry treating apparatus. A separate display 91 may also be provided at the control panel 90, to display contents of operation of the laundry treating apparatus.

The top lid 80 may be mounted to the top cover 70 by a connecting member such as a hinge such that it can be opened and closed. Accordingly, the user can load laundry into the washing tub 30 or unload washed laundry from the washing tub 30 after opening the top lid 80.

As shown in FIG. 2, in accordance with the illustrated embodiment, the top lid 80 is pivotally connected to a rear portion of the top cover 70 by a hinge. The top lid 80 is mounted such that it is upwardly pivoted about the hinge from a front side, to open and close the laundry treating apparatus.

In order to allow the user to easily open and close the top lid 80, a grip 85 may be formed at a front portion of the top lid 80. More preferably, the top lid 80 may be folded at a central portion thereof, in order to allow the user to open and close the top lid 80 by lifting the top lid 80 along a track having a small radius.

Meanwhile, the laundry treating apparatus may further include an air flow assembly 100 for forming a passage communicating the interior of the outer case 10 and the exterior of the outer case 10. The air flow assembly 100 may be installed at the top of the top lid 80.

In a general laundry treating apparatus, which treats laundry, using wash water supplied from the outside of the laundry treating apparatus, a certain amount of water may be left on an inner wall of a water tub containing the wash water and in a draining passage, even after the wash water is drained upon completion of operation of the laundry treating apparatus.

For this reason, if the interior of the laundry treating apparatus is completely sealed from the exterior of the laundry treating apparatus, it may be maintained in a high humid state due to the left water. In this case, a circuit board included in a control panel of the laundry treating apparatus may be short-circuited due to moisture. In addition, where the laundry treating apparatus is maintained in the sealed state for a prolonged period of time, there may be a sanitation problem in that an offensive odor may be generated, or mold or bacteria may propagate.

Therefore, it is desirable to communicate the interior of the laundry treating apparatus and the exterior of the laundry treating apparatus, using the air flow assembly 100, as in the illustrated embodiment.

In this case, the laundry treating apparatus is provided with a passage allowing ambient air to enter and leave the interior of the laundry treating apparatus. Accordingly, there is an advantage in that moisture present in the interior of the laundry treating apparatus can be naturally discharged to the exterior of the laundry treating apparatus.

The introduction of ambient air through the air flow assembly 100 may be promoted by a differential pressure generated during rotation of the washing tub 30.

When a spin-drying operation is carried out as a final process in a washing cycle, ambient air is positively introduced into the washing tub 30 in accordance with a high-speed rotation of the washing tub 30, and then outwardly ejected from the washing tub 30. Thus, the ambient air performs a function to take off wash water left on the inner wall of the water tub 30. As a result, the amount of water left on the water tub after the completion of operation of the laundry treating apparatus is considerably reduced.

Where a laundry drying operation is performed after the completion of the washing operation in the laundry treating apparatus, under the condition in which the washing tub 30 rotates, humid air produced during the laundry drying operation can be exchanged with ambient dry air in accordance with the rotation of the washing tub 30. In this case, accordingly, an enhancement in laundry drying efficiency is achieved.

When the deviation of the installation position of the air flow assembly 100 on the top lid 80 from the center of the washing tub 30 increases, the amount of ambient air introduced into the washing tub 30 during rotation of the washing tub 30 increases. Accordingly, it is desirable to form the air flow assembly at a position deviated to one side of the top lid 80.

Ambient air introduced during rotation of the washing tub is directed to a rotational center of the washing tub. For this reason, it is desirable to provide a door 150 installed to be openable in an outward direction of the washing tub 30 such that the door 150 guides ambient air introduced in an opened state thereof toward the rotational center of the washing tub 30.

Figure 3:
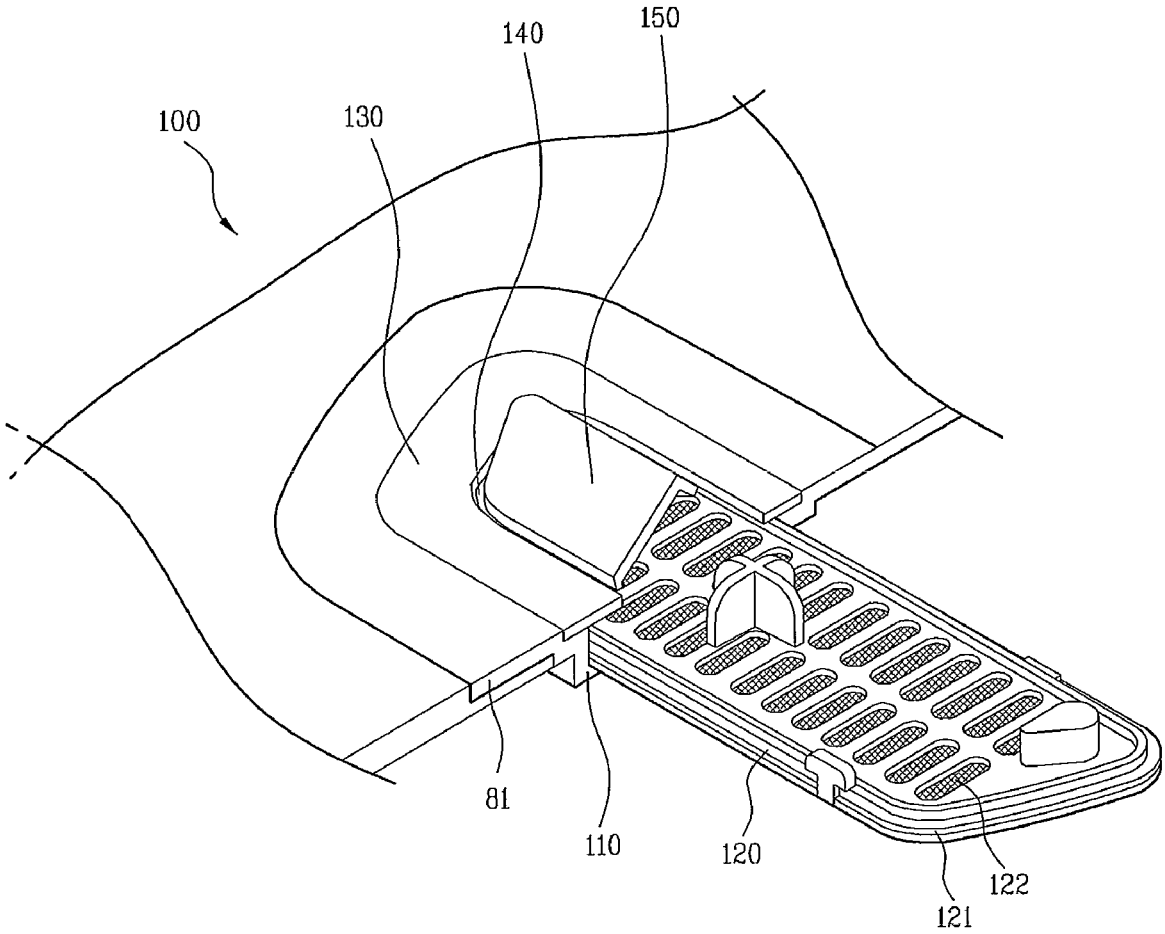
FIG. 3 is a sectional view illustrating an air flow assembly according to the illustrated embodiment of the present invention.

FIG. 3 is a sectional view illustrating the air flow assembly 100. Hereinafter, the air flow assembly 100 will be described in detail with reference to FIG. 3.

In the illustrated embodiment, as shown in FIG. 3, the air flow assembly 100 includes a ventilating member 110 for allowing ambient air to enter and leave the air flow assembly 100, and a decoration member 130 seated on the top lid 80, to define an appearance of the air flow assembly 100, in addition to the door 150 which opens and closes the ventilating member 110.

A plurality of ventilating holes (not shown) may be formed through the ventilating member 110. Accordingly, air present in the interior of the outer case 10 may be exchanged with ambient air through the ventilating holes.

The ventilating member 110 is preferably mounted at a position downwardly stepped from an upper surface of the top lid 80. This is because it is undesirable for the structure of the ventilating member 110 to be outwardly exposed.

The ventilating member 110 may be directly installed on the top lid 80 in the form of a step. Of course, it is preferred that the ventilating member 110 be integrally formed with the decoration member 130 while being downwardly stepped from the upper surface of the top lid 80 such that the air flow assembly 100 can be mounted to the top lid 80 after being separately manufactured, as in the illustrated embodiment.

Meanwhile, as shown in FIG. 3, the air flow assembly 100 according to the illustrated embodiment may further include a filter unit 120 for filtering ambient air introduced into the laundry treating apparatus through the air flow assembly 100, to remove foreign matter from the introduced ambient air.

The filter unit 120 may include a filter 122 for removing foreign matter from air, and a housing 121 for holding the filter 122.

It is preferred that the housing 121 be firmly mounted to the air flow assembly 100 within the air flow assembly 100 so that it is prevented from being moved during opening and closing of the top lid 80. In the illustrated embodiment, the filter unit 120 is separably mounted over the ventilating member 110 so that it can be easily replaced by a new one, and can be easily cleaned.

Preferably, the housing 121 has an opening area to provide a sufficient air passage for air flowing through the ventilating holes of the ventilating member 110. In the illustrated embodiment, as shown in FIG. 3, the housing 121 has a structure having holes corresponding to respective ventilating holes of the ventilating member 110.

Meanwhile, the decoration member 130 may be exposed at the upper surface of the top lid 80, to define an appearance of the air flow assembly 100 while protecting the ventilating member 110 and filter unit 120.

Preferably, an opening 140 having a certain size is formed through the decoration member 130 in a region corresponding to the ventilating member 110, to allow air to flow between the interior and exterior of the outer case 10. It is also preferred that the decoration member 130 be installed such that an outer portion thereof is coupled with the upper surface of the top lid 80.

To this end, a seat 81 may be provided at the upper surface of the top lid 80 such that it is stepped from the upper surface of the top lid 80 to a certain depth while extending along an upper edge of the ventilating member 110. In this case, the decoration member 130 is seated on the seat 81.

Preferably, the depth of the seat 81 stepped from the upper surface of the top lid 80 corresponds to the thickness of the decoration member 130. In this case, an enhancement in appearance beauty is achieved because the decoration member 130 is flush with the upper surface of the top lid 80 while being protruded from the upper surface of the top lid 80.

Figure 4:
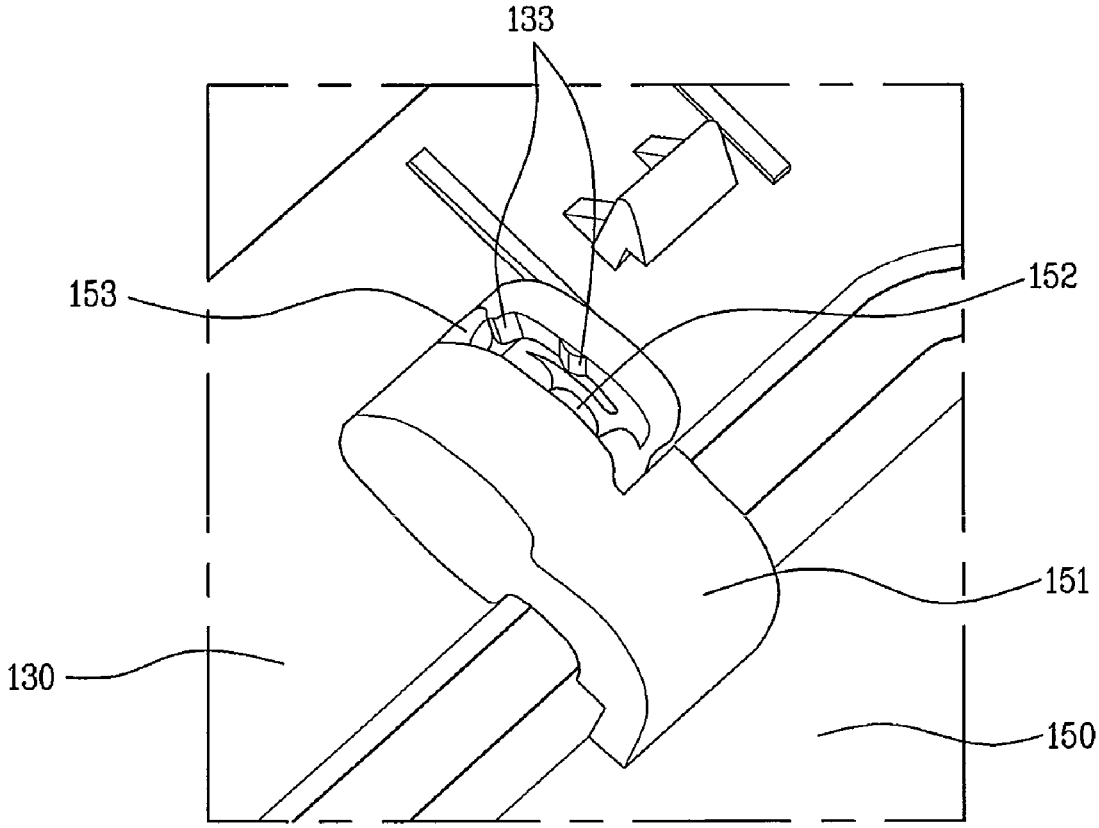
FIG. 4 is a bottom view schematically illustrating a coupling structure for a door.
Figure 5:
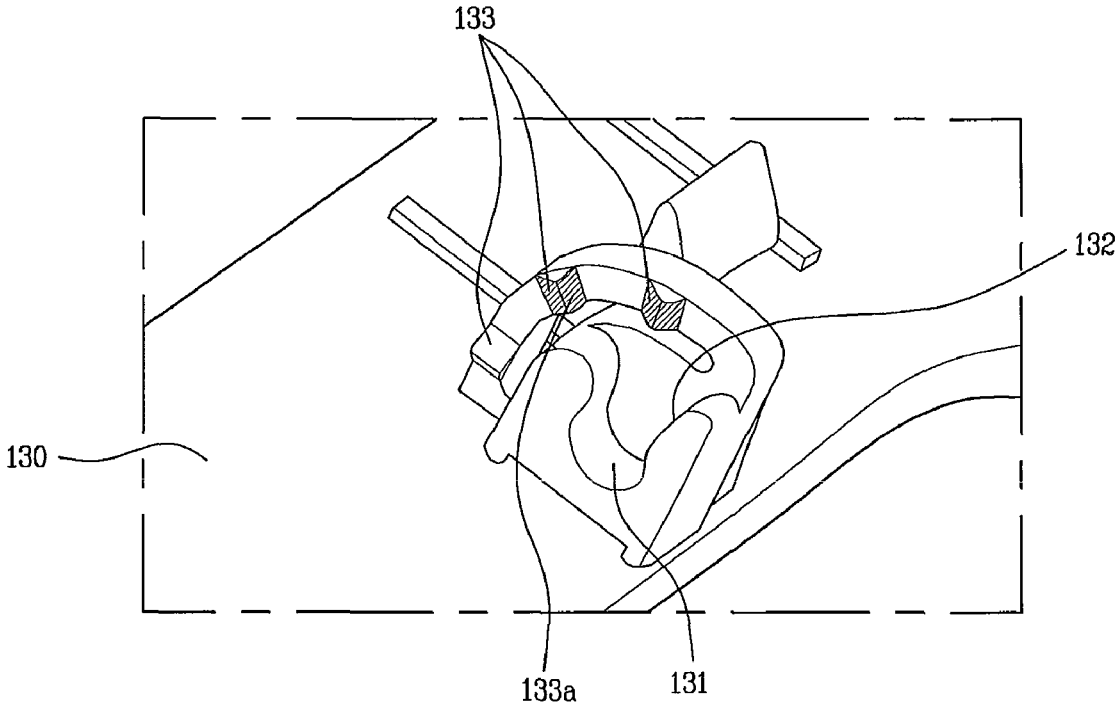
FIGS. 5 and 6 are exploded perspective view illustrating the coupling structure of FIG. 4.
Figure 6:
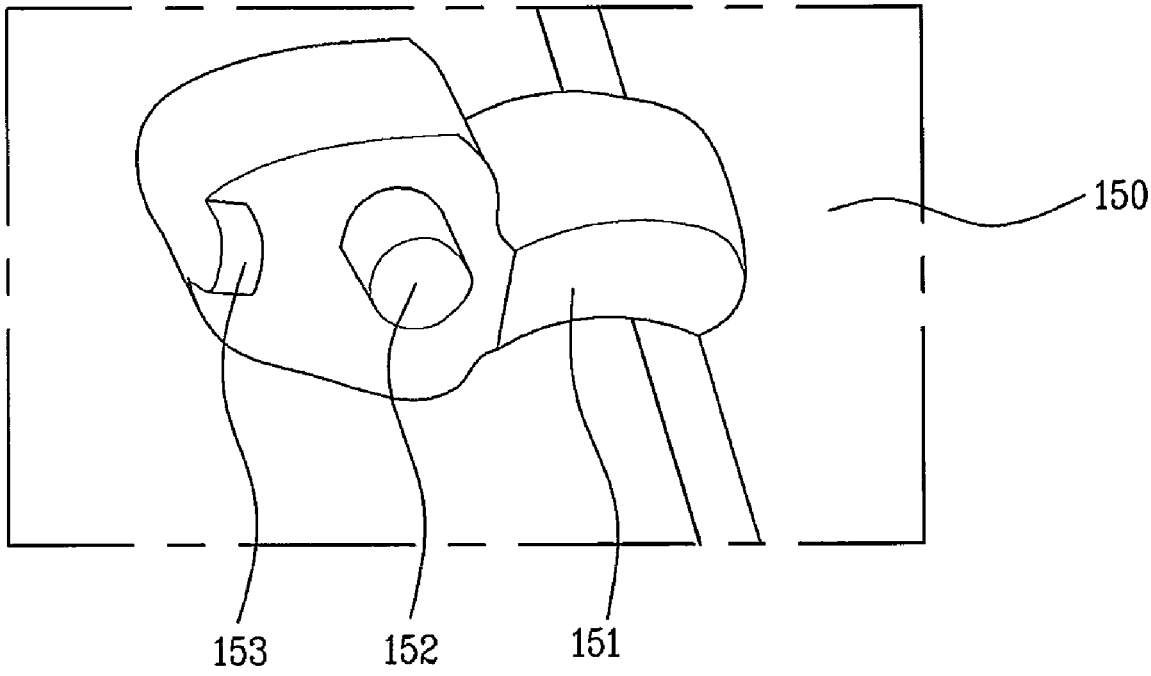

FIG. 4 is a bottom view schematically illustrating a coupling structure for the door 150. FIGS. 5 and 6 are exploded perspective view illustrating the coupling structure of FIG. 4. Hereinafter, the door 150 will be described in detail with reference to FIGS. 4 and 5.

It is preferred that the air flow assembly 100 included in the laundry treating apparatus according to the present invention be configured to stepwise adjust the size of the passage communicating with the outside of the laundry treating apparatus. In the illustrated embodiment, the door 150 is provided to open and close the opening 140 arranged over the ventilating member 110. Also, the door 150 is configured to stepwise adjust an opening degree thereof.

As described above, the air flow assembly 100 forms the passage communicating the interior of the outer case 10 with the exterior of the outer case 10. The amount of air flowing through the passage is varied in accordance with a variation in the size of the passage. Also, the laundry treating apparatus may require different passage sizes in accordance with different operation states.

For example, when the inner wall of the water tub 20 is dried after the completion of operation of the laundry treating apparatus, the drying may be more rapidly achieved at a larger size of the passage. On the other hand, it is desirable for the passage to be maintained in a reduced state, after the completion of the drying of the water tub 20, in order to prevent introduction of foreign matter through the passage.

Meanwhile, where drying of laundry is carried out by supplying hot air while rotating the washing tub 30, it can be effectively achieved as dry ambient air is introduced into the washing tub 30, and exchanged with humid air present in the washing tub 30. However, where the passage is excessively large, hot air circulating in the laundry treating apparatus may be outwardly discharged from the laundry treating apparatus, thereby causing a degradation in drying efficiency.

Thus, it is preferred that the air flow assembly 100 be configured to stepwise adjust the size of the passage because the size of the passage required in the laundry treating apparatus is varied in accordance with the operation state of the laundry treating apparatus.

Accordingly, in the illustrated embodiment, the door 150 may be configured to open and close the passage while pivoting about a certain axis, as shown in FIG. 4. In this case, the door 150 can stepwise adjust a pivoting angle thereof, thereby adjusting the size of the passage communicating with ambient air.

In detail, the door 150 is pivotally connected to the decoration member 130 by a hinge unit, to open and close the opening 140 of the decoration member 130.

As shown in FIG. 4, the door 150 may include at least one pivot arm 151 extending forwardly to be coupled with the decoration member 130. In the illustrated embodiment, two pivot arms 151 are provided at opposite sides of the door 150, respectively.

The hinge unit includes a boss 152 protruded from a front end of each pivot arm 151 at one side of the pivot arm 151, an engagement rib 153 protruded from one end of the pivot arm 151 while being spaced apart from the boss 152, and a pivot support 132 formed at the lower surface of the top lid 80, to pivotably support the boss 152.

First, the pivot support 132 will be described.

In detail, the pivot support 132 includes a boss groove 131 formed at the decoration member 130, to pivotably receive the boss 152, and a plurality of protrusions 133 engaged, at a selected one thereof, with the engagement rib 153 in a state in which the boss 152 is received in the boss groove 131. Thus, the door 150 is pivotably installed as the boss 152 of the door 150 is pivotably received in the boss groove 131 of the decoration member 130.

In order to prevent the door 150 from pivoting freely, it is preferred that the pivoting of the door 150 be stepwise restricted in accordance with an engagement between the engagement rib 153 and a selected one of the protrusions 133.

That is, the protrusions 133 are arranged along a movement path of the engagement rib 153 established when the door 150 pivots, in order to prevent the door 150 from pivoting freely. Accordingly, the pivotal movement of the door 150 can be restricted in accordance with an engagement of the engagement rib 153 with a selected one of the protrusions 133.

Of course, it is preferable that, even in a state, in which the pivotal movement of the door 150 is restricted in accordance with an engagement of the engagement rib 153 with a selected one of the protrusions 133, the engagement rib 153 can pass over the protrusion 133 engaged therewith by virtue of an elasticity of the engagement rib 153 or protrusion 133 when the user presses the door 150.

Thus, although a free pivotal movement of the door 150 is normally restricted by the engagement of the engagement rib 153 with a selected one of the protrusions 133, it is possible to easily adjust the opening degree of the door 150 by simply pivoting the door 150 by one hand.

In detail, as shown in FIG. 5, the plurality of protrusions 133 are installed such that they are arranged adjacent to one another along a circumferential direction of the boss 152 in a coupled state of the boss 152. Each protrusion 133 may be protruded toward the pivot arm 151.

Preferably, the engagement rib 153 is protruded from the front end of the pivot arm 151 in a direction parallel to the boss 152. It is also preferred that the engagement rib 153 is arranged such that it is engaged between adjacent ones of the protrusions 133 in a coupled state of the boss 152. In accordance with the engagement of the engagement rib 153 with the adjacent protrusions 133, the pivotal movement of the door 150 is restricted.

Of course, since the engagement rib 153 or each protrusion 133 is made of a material having a certain elasticity, the engagement rib 153 can pass over the engaged protrusions 133 when the user pivots the door 150 while pressing the door 150. That is, the user can adjust the opening degree of the door 150 by pivoting the door 150 while depressing the door 150. When the user stops the pivotal movement of the door 150 at a desired position, the engagement rib 153 is engaged with the protrusion 133 corresponding to that position. Thus, it is possible to maintain the door 150 at a desired position corresponding to a desired opening degree.

In order to allow the engagement rib 153 to easily pass over the protrusions 133 when the user presses the door 150, each protrusion 133 may have a surface 133*a* inclined in a pivoting direction of the engagement rib 153.

Since the door 150 can pivot in opposite directions, namely, upward and downward directions, each protrusion 133 preferably has surfaces 133*a* respectively inclined in opposite movement directions of the engagement rib 153.

In the illustrated embodiment, it is preferred, in terms of appearance beauty, that the pivot arm 151 extend from the door 150 in downward and forward directions, and the coupling between the boss 152 and the boss groove 131 be achieved beneath the decoration member 130.

In order to allow the door 150 to be sufficiently opened, it is preferable to install the boss groove 131 at a position adjacent to the opening 140 of the decoration member 130, namely, at a position adjacent to an inner edge of the decoration member 130. In this case, it is possible to minimize the length of the pivot arm 151 extending beneath the decoration member 130. Accordingly, it is possible to prevent a phenomenon that the pivot arm 151 is engaged with the decoration member 130 upon opening the door 150, so that the opening operation of the door 150 is restricted.

Where the portion of the inner edge of the decoration member 130, which comes into contact with the pivot arm 151 upon a pivotal movement of the pivot arm 151, is formed to have a concave structure, there is an advantage in that the pivoting radius of the door 150 can be increased.

Thus, in accordance with the illustrated embodiment, it is possible to selectively adjust the opening degree of the door 150, and thus to adjust the size of the passage, if necessary.

Although the boss 152 and engagement rib 153 are provided at the door 150, and the boss groove 131 and protrusions 133 are provided at the decoration member 130, they may be provided at reversed positions. Also, the present invention may be implemented into various modified structures, based on the principles taught in the embodiments of the present invention.

For example, there may be another embodiment associated with the coupling structure for the door. Hereinafter, this will be described with reference to FIG. 7.

Figure 7:
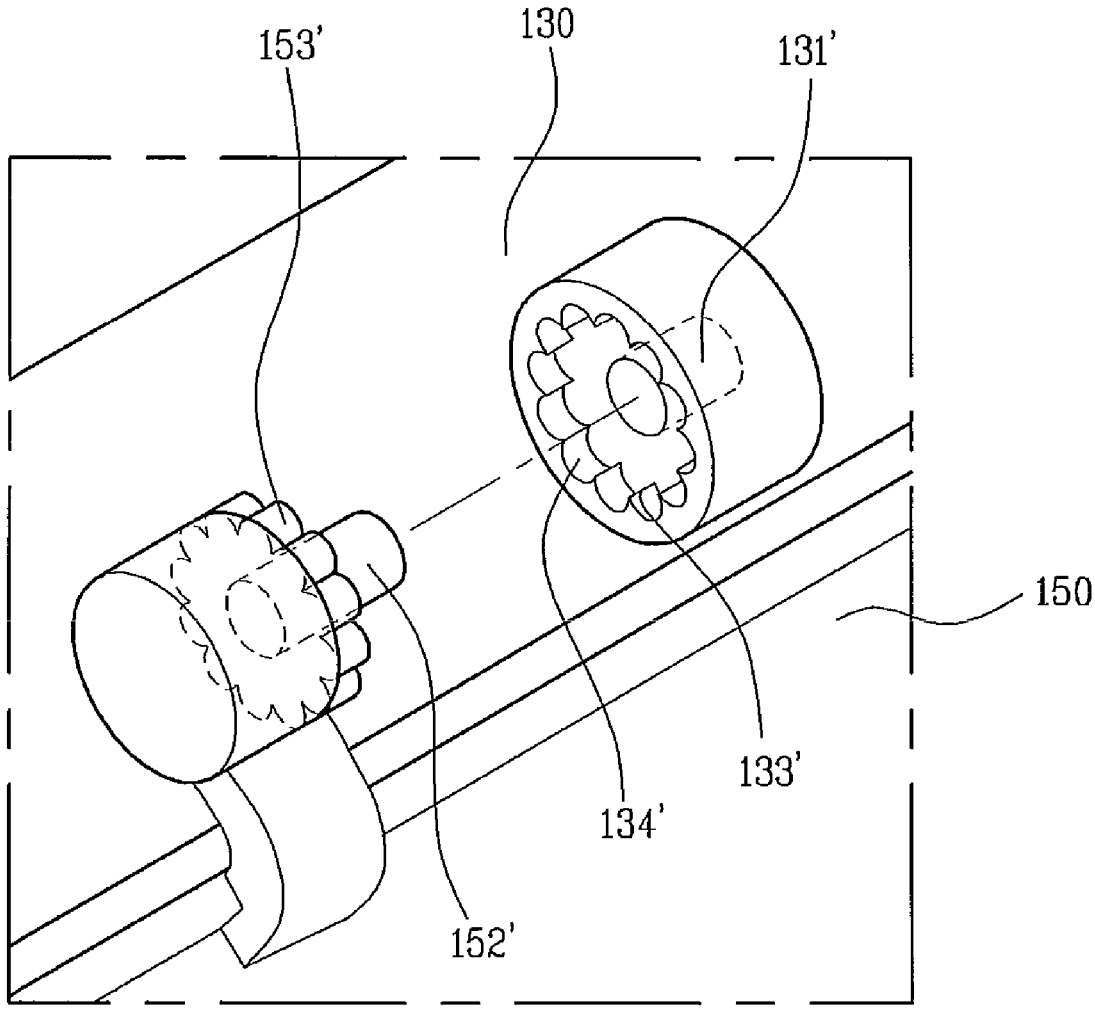
FIG. 7 is an exploded perspective view illustrating a coupling structure for the door according to another embodiment of the present invention.

The embodiment of FIG. 7 is similar to the previous embodiment in that the boss provided at the door is pivotally coupled with the boss groove provided at a lower portion of the decoration member. However, the embodiment of FIG. 7 is different from the previous embodiment in terms of the structures of protrusions and engagement rib for restricting the pivotal movement of the door.

The hinge unit according to this embodiment includes a boss 152' protruded from one side of a pivot arm 151', a plurality of engagement ribs 153' protruded from the pivot arm 151' around the boss 152' while being spaced apart from the boss 152' by a certain distance, and a pivot support 132' formed at the lower surface of the top lid 80, to pivotably support the boss 152'.

The engagement ribs 153' have a cylindrical shape, and are continuously connected to one another around the boss 152'.

In detail, the pivot support 132' includes a boss groove 131' formed at a decoration member 130, to pivotably receive the boss 152', a step 134' formed to be stepped from the boss groove 131' while being concentric with the boss groove 131' and radially spaced apart from the boss groove 131', and a plurality of protrusions 133' protruded from an inner circumferential surface of the step 134'.

The step 134' and protrusions 133' form a shape corresponding to a shape formed by the engagement ribs 153'.

When the boss 152' is received in the boss groove 131', the engagement ribs 153' are seated on the step 134' such that each engagement rib 153' is engaged between adjacent ones of the protrusions 133'. When the user presses the door 150, each protrusion 133' engaged between the adjacent protrusions 133' is disengaged from the protrusions 133' engaged therewith, and then engaged between next adjacent protrusions 133'. Thus, the pivoting angle of the door can be stepwise adjusted.

In order to achieve an easy pivotal movement of the door 150 when the user pivots the door 150 while pressing the door 150, it is preferred that the engagement ribs 153' or protrusions 133' be made of a material having a certain elasticity. Similarly to the previous embodiment, it is possible to maintain the door 150 at a desired position corresponding to a desired opening degree as each engagement rib 153' can be engaged between desired protrusions 133' after passing over a desired number of protrusions 133' in this embodiment.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

For example, although the door 150 is pivotally coupled to the decoration member 130 in the above-described embodiments, it may be directly coupled to the top lid without using the decoration member 130. In addition, the door 150 may be installed to selectively adjust the size of the passage communicating with the outside of the laundry treating apparatus, using a coupling method other than the hinge-coupling method.

The laundry treating apparatus according to the present invention prevents moisture from staying in the interior of the laundry treating apparatus for a prolonged period of time, even in a closed state of the top lid. Accordingly, it is possible to prevent a failure of the laundry treating apparatus, generation of an offensive odor and propagation of bacteria in the interior of the laundry treating apparatus.

In addition, it is possible to achieve an enhancement in air communication effect because the size of the passage communicating with ambient air can be selectively adjusted in accordance with the operation state of the laundry treating apparatus.

What is claimed is:

1. A laundry treating apparatus comprising:

an outer case defining an appearance of the laundry treating apparatus;

a washing tub arranged in the outer case, to receive laundry;

a top lid mounted to a top of the outer case such that the top lid is openable and closeable; and an air flow assembly mounted to the top lid, to stepwise adjust a size of a passage communicating an interior of the outer case and an exterior of the outer case, wherein the air flow assembly comprises a door stepwise pivotable to stepwise adjust an opening/closing degree of the passage, wherein the door comprises a plurality of pivot arms extending from one side of the door, to support the door, and a hinge unit pivotably supporting the pivot arms, and wherein the hinge unit comprises a boss protruded from one side of each pivot arm, an engagement rib protruded from one end of the pivot arm while being spaced apart from the boss, and a pivot support formed at a lower surface of the top lid, to pivotably support the boss.

2. The laundry treating apparatus according to claim 1, wherein the pivot support comprises a boss groove to pivotably receive the boss, and a plurality of protrusions engaged, at a selected one thereof, with the engagement rib in a state in which the boss is received in the boss groove, to stepwise restrict a pivoting angle of the pivot arm.

3. The laundry treating apparatus according to claim 2, wherein a pivotal angle of the door is adjusted as the engagement rib passes over the selected protrusion when the door is pressed, and is then engaged with a next one of the protrusions.

4. The laundry treating apparatus according to claim 3, wherein the protrusions are formed along a circumferential direction of the boss, and each of the protrusions has an inclined surface to allow the engagement rib to easily pass over the protrusion when the door is pressed.

5. The laundry treating apparatus according to claim 4, wherein at least one of the engagement rib and each protrusion has a predetermined elasticity to allow the protrusion rib to pass over the protrusion.

6. A laundry treating apparatus comprising:

an outer case defining an appearance of the laundry treating apparatus;

a washing tub arranged in the outer case, to receive laundry;

a top lid mounted to a top of the outer case such that the top lid is openable and closeable; and an air flow assembly mounted to the top lid, to stepwise adjust a size of a passage communicating an interior of the outer case and an exterior of the outer case, wherein the air flow assembly comprises a door stepwise pivotable to stepwise adjust an opening/closing degree of the passage, wherein the door comprises a plurality of pivot arms extending from one side of the door, to support the door, and a hinge unit pivotably supporting the pivot arms, and wherein the hinge unit comprises a boss protruded from one side of each pivot arm, a plurality of engagement ribs protruded from the pivot arm around the boss while being spaced apart from the boss by a predetermined distance, and a pivot support formed at a lower surface of the top lid, to pivotably support the boss.

7. The laundry treating apparatus according to claim 6, wherein the engagement ribs have a cylindrical shape, and are continuously connected to one another around the boss.

8. The laundry treating apparatus according to claim 7, wherein the pivot support comprises a boss groove to pivotably receive the boss, a step formed to be stepped from the boss groove while being concentric with the boss groove and radially spaced apart from the boss groove by a predetermined distance, and a plurality of protrusions protruded from an inner circumferential surface of the step, each of the protrusions being engaged between adjacent ones of the engagement ribs, to stepwise restrict a pivoting angle of the pivot arm.

9. The laundry treating apparatus according to claim 8, wherein the step and the protrusions form a shape corresponding to a shape formed by the engagement ribs.

10. The laundry treating apparatus according to claim 9, wherein a pivotal angle of the door is adjusted as each engagement rib passes over the protrusions engaged with the engagement rib when the door is pressed, and is then engaged between next ones of the protrusions.

11. The laundry treating apparatus according to claim 10, wherein at least one of each engagement rib and each protrusion has a predetermined elasticity to allow the protrusion rib to pass over the protrusion.

* * * * *